United States Patent [19]

Stangeland

[11] 4,162,962

[45] Jul. 31, 1979

[54] SEQUENTIAL HYDROCRACKING AND HYDROGENATING PROCESS FOR LUBE OIL PRODUCTION

[75] Inventor: Bruce E. Stangeland, Berkeley, Calif.

[73] Assignee: Chevron Research Company, San Francisco, Calif.

[21] Appl. No.: 945,743

[22] Filed: Sep. 25, 1978

[51] Int. Cl.[2] ..... C10G 13/02; C10G 37/06; B01J 35/10

[52] U.S. Cl. ..... 208/58; 208/18; 208/97; 208/143; 208/264; 252/458; 252/477 R

[58] Field of Search ..... 208/58, 59, 18

[56] References Cited

U.S. PATENT DOCUMENTS

| | | | |
|---|---|---|---|
| 3,666,657 | 5/1972 | Thompson et al. | 208/58 |
| 3,852,207 | 12/1974 | Stangeland et al. | 208/58 |
| 3,870,622 | 3/1975 | Ashton et al. | 208/93 |
| 3,876,522 | 4/1975 | Campbell et al. | 208/58 |
| 4,081,406 | 3/1978 | Sawyer | 252/465 X |
| 4,102,822 | 7/1978 | Mulaskey | 252/465 X |

*Primary Examiner*—Delbert E. Gantz
*Assistant Examiner*—G. E. Schmitkons
*Attorney, Agent, or Firm*—D. A. Newell; R. H. Davies; M. K. Bosworth

[57] ABSTRACT

UV-unstable hydrocrackate lube oil stock is improved by hydrogenating the stock at a temperature in the 200° to 300° C. range using a hydrogenating component disposed upon an alumina carrier having a substantial pore volume of which a major portion is in pores having diameters in the 80- to 150-Angstrom range.

11 Claims, 1 Drawing Figure

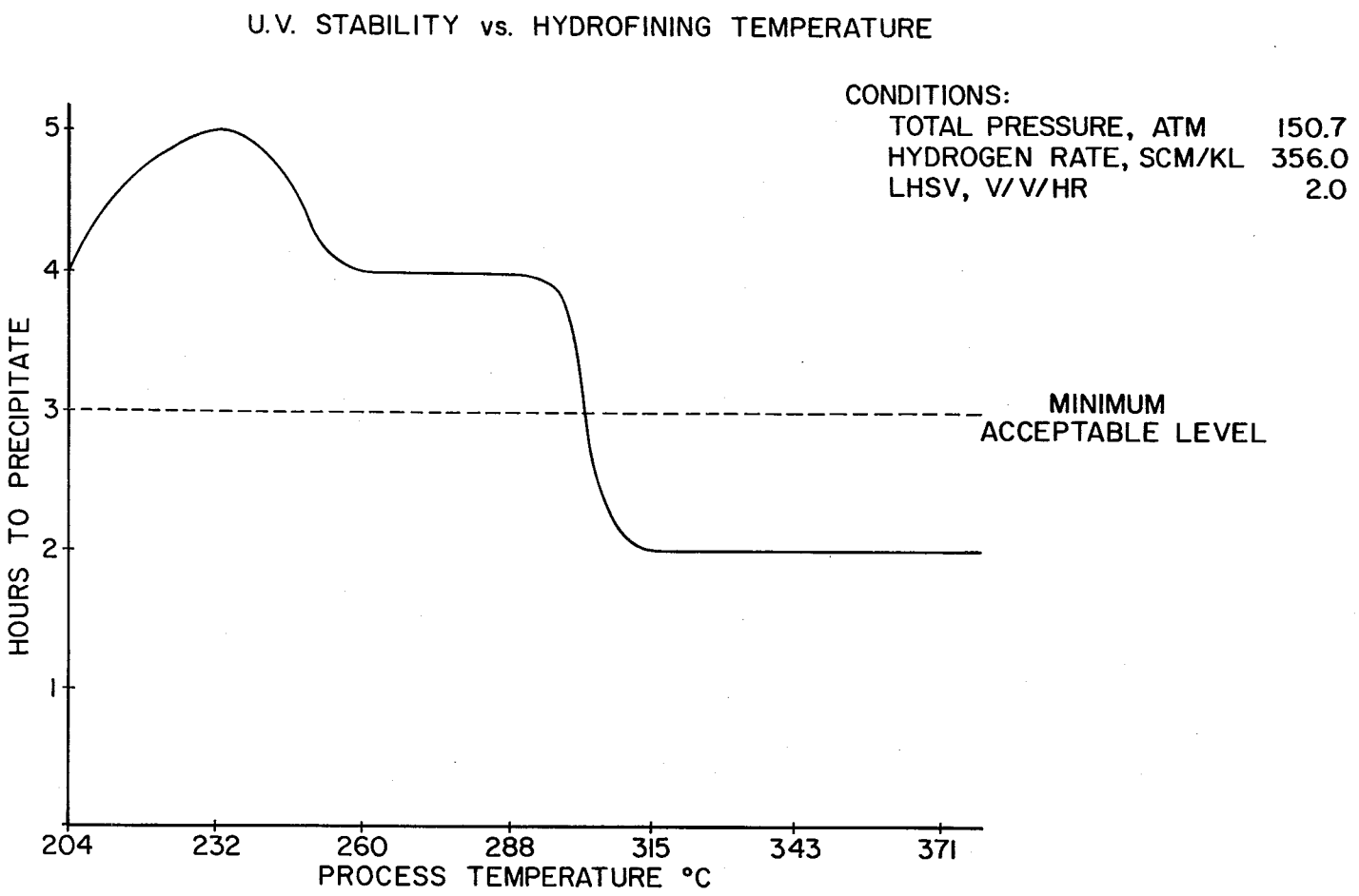
U.V. STABILITY vs. HYDROFINING TEMPERATURE
CONDITIONS:
TOTAL PRESSURE, ATM 150.7
HYDROGEN RATE, SCM/KL 356.0
LHSV, V/V/HR 2.0
MINIMUM
ACCEPTABLE LEVEL
HOURS TO PRECIPITATE
5
4
3
2
1
204
232
260
288
315
343
371
PROCESS TEMPERATURE °C

SEQUENTIAL HYDROCRACKING AND HYDROGENATING PROCESS FOR LUBE OIL PRODUCTION

BACKGROUND OF THE INVENTION

This invention relates to an improved sequential hydrocracking and hydrogenating process for the production of UV-stable lube oils. More particularly, it relates to the use of an improved catalyst for the hydrogenating step of the sequential process.

Lube oils produced by hydrocracking heavy oils such as vacuum gas oils and deasphalted residuum oils are well known for their poor stabilities as shown by the UV stability test described below. Representative methods for alleviating this problem are described in U.S. Pat. Nos. 3,666,657 (S. L. Thompson et al) and 3,852,207 (B. E. Stangeland et al). Nevertheless, there remains a need for process improvements, for example in terms of milder conditions and/or less costly catalysts.

An object herein is to provide an improved sequential hydrocracking and hydrotreating process for the production of lubricating oil from the aforementioned hydrocarbon feedstocks.

SUMMARY OF THE INVENTION

The present invention involves the discovery that a satisfactory lube oil is produced from a hydrocrackate lube oil stock by hydrogenating the stock, provided that the hydrogenating is carried out at a temperature in the range of about 200° to 300° C. using a catalyst having a carrier consisting essentially of porous alumina having a particular pore size distribution. Thus, a process is provided for upgrading a hydrocrackate lube oil stock boiling in the range above 290° C. and having a UV stability below 3 hours, comprising contacting said stock and hydrogen gas with a catalyst containing an effective amount of a hydrogenating agent disposed upon a porous carrier consisting essentially of alumina having a pore volume in the range of from about 0.4 to 1.1 cc per gram, of which at least 70% is in pores having diameters in the range of from about 80 to 150 Angstroms, said contacting being under hydrogenating conditions, including (1) a temperature in the range of from about 200° to 300° C., (2) a total pressure in the range of from about 129 to 171 atmospheres, (3) a hydrogen rate in the range of from about 382 to 509 standard cubic meters of hydrogen gas per kiloliter of feed, and (4) a liquid hourly space velocity in the range of from about 1 to 3 V/V/hr, said agent being a Group VI-B and VIII components selected from the group consisting of molybdenum, tungsten, cobalt and nickel, said components being in at least one of the metal, oxide and sulfide forms thereof, and said amount, calculated as metal and based upon the catalyst by weight, being in the range of from about 1 to 20%, thereby producing a lube oil having a UV stability of at least 4 hours.

In a further aspect of the invention, a sequential process is provided wherein a lubricating oil from a heavy oil, for example a feedstock selected from the group consisting of vacuum gas oils, deasphalted oils and mixtures thereof, said feedstock having a normal boiling point range in the range above about 340° C., said process including steps of catalytically hydrocracking said feedstock in a hydrocracking zone under hydrocracking conditions and catalytically hydrogenating in a hydrogenating zone under hydrogenating conditions at least a substantial portion of the effluent from said hydrocracking zone, said portion having a UV stability of less than 3 hours and a normal boiling point range in the range of from about 290° C. to 650° C., said hydrogenating conditions including using a catalyst having a Group VI-B and a Group VIII hydrogenating agent disposed therein, said agents being in at least one of the metal, oxide and sulfide forms thereof, the improvement comprising carrying out said hydrogenating at a temperature in the range of from about 200° to 300° C., preferably 204° to 260° C., more preferably about 232° C., wherein said carrier consists essentially of porous alumina having a pore volume in the range of from about 0.4 to 1.1 cc per gram of which at least 70% is in pores having diameter in the range of from about 80 to 150 Angstroms, thereby producing a lube oil having a UV stability of at least about 4 hours.

BRIEF DESCRIPTION OF THE DRAWING

The FIGURE illustrates the effect upon the UV stability of a lube oil product as a function of the temperature used in hydrogenating a hydrocrackate lube oil stock. The catalyst employed for the hydrogenating is described below under the description of a preferred embodiment.

EMBODIMENT

In a preferred embodiment, a hydrocrackate obtained by hydrocracking an Arabian light vacuum gas oil is used as the feedstock. The feedstock had a normal boiling point range of 370° to 590° C. The hydrogenating catalyst has the following characteristics:

| Carrier | $Al_2O_3$ |
|---|---|
| Pore Volume, cc/g | 0.6 |
| Pores in Diameter Range, % of P.V. | |
| 80–150 A. | >70 |
| >1000 A. | < 3 |
| Hydrogenating Component, as Metal, Wt. % of Composite | |
| Cobalt | 3 |
| Molybdenum | 11 |
| Other, as Element, Wt. % of Composite | |
| Phosphorus | 2 |

This catalyst is made in the manner described in U.S. Pat. 4,066,574 (P. W. Tamm), which is incorporated herein by reference, and the process conditions are as follows:

| | |
|---|---|
| Temperature, °C. | 232 |
| Total Pressure, Atm. | 151 |
| Hydrogen Rate, SCM/KL | 424 |
| LHSV, V/V/Hr. | 2 |

The resulting lube oil product has a UV stability of about 5 hours.

The process conditions which, in general, are satisfactory for use herein include the following:

| | Broad | Preferred |
|---|---|---|
| Temperature, °C. | 200–300 | 204–260 |
| Total Pressure, Atm. | 100–200 | 129–171 |
| Hydrogen Rate, SCM/KL | 318–531 | 382–509 |
| LHSV, V/VHr. | 0.1–5 | 1–3 |

FEEDSTOCKS

Heavy hydrocarbons, in general, typically used as feedstocks in a hydrocracking stage for hydrocrackate lube oil production are satisfactory for use herein. Preferred feedstocks are vacuum gas oils with normal boiling ranges in the range 370° to 590° C., and solventdeasphalted oils having normal boiling ranges from about 480° to 650° C. Reduced topped crude oils as well as atmospheric residua, e.g., heavy oils, and the like may also be used. In general, preferred feedstocks are limited to hydrocarbon mixtures boiling above 340° C., preferably in the range of about 370° to 650° C.

Hydrocrackate lube oil stocks, in whole or part, as obtained by hydrocracking the heavy oils described above, are, in general, satisfactory feeds for producing upgraded lube oils by hydrogenating as in the present process. These hydrocrackates typically have UV stabilities of less than 3 hours and consequently do not satisfy minimum standards of the trade. They usually have normal boiling point ranges in the range of from about 290° to 650° C. Preferred hydrocrackate feeds have a normal boiling point range in the range of from about 340° to 565° C.

HYDROCRACKING STEP

The process conditions required for the hydrocracking step are those typically employed and of themselves are not considered inventive. These include:

| | Broad | Preferred |
|---|---|---|
| Temperature, °C. | 260–482 | 340–426 |
| Pressure, Atm. | 35–681 | 35–205 |
| LHSV, V/V/Hr | 0.2–5 | 0.5– |
| Hydrogen Rate, SCM/KL | 106–1061 | 244–424 |

It should be noted that, while hydrocracking is the primary reaction being carried out, the feedstocks used generally contain organic compounds of sulfur, nitrogen, oxygen and even metals in some cases. Therefore, hydrodesulfurization, hydrodenitrification, etc., also occur to a greater or lesser extent.

HYDROCRACKING CATALYSTS

Catalysts employed in the hydrocracking zones include those having hydrogenation-dehydrogenation activity, together with an active cracking component support. Exemplary cracking component supports include silica-alumina, silica-alumina-zirconia composites, acid-treated clays, crystalline aluminosilicate zeolitic molecular sieves such as Zeolite A, faujasite, Zeolite X and Zeolite Y, and combinations of the above. Hydrogenation-dehydrogenation components of the catalyst preferably comprise a metal selected from Group VIII metals and compounds thereof and Group VI-B metals and compounds thereof. Preferred Group VIII components include cobalt, nickel, platinum and palladium, particularly the oxides and sulfides of cobalt and nickel. Preferred Group VI-B components are the oxides and sulfides of molybdenum and tungsten. Thus, examples of hydrocracking catalysts which would be preferred for use in the process are the combinations nickel-tungsten-silica-alumina and nickel-molybdenum-silica-alumina. Such catalysts may vary in their activities for hydrogenation and for cracking and in their ability to sustain high activity during long periods of use depending upon their compositions and methods of preparation. It will be within the ability of those skilled in the art, from the description herein, to chose the optimum catalyst or catalysts for use with a given feedstock.

A particularly preferred hydrocracking catalyst for use in the present process is a nickel sulfidetungsten sulfide on a silica-alumina base containing discrete, metal phosphate particles, such as that described in U.S. Pat. No. 3,493,517, the teachings of which are incorporated herein by reference.

HYDROGENATION STEP

Typical hydrogenating conditions usually include contacting a hydrogenatable feedstock with a catalyst containing a Group VI-B and/or Group VIII hydrogenating component in the presence of hydrogen, for example as disclosed in the Thompson et al and Stangeland et al patents cited above. In order to achieve effective hydrogenation as herein under relatively mild conditions of temperature and pressure, the hydrogenating component, which is preferably molybdenum or tungsten and cobalt or nickel, must be disposed upon a porous alumina carrier having a substantial pore volume, for example in the range of from about 0.4 to 1.1 cc per gram, of which at least a major portion thereof, preferably at least 70% and more preferably at least 85%, is in pores (micropores) having diameters in the 80– to 150-Angstrom range (determination being made by the B.E.T. method). The balance of the pore volume will be in pores sized in the diameter range above 150 and below 80 Angstroms. Because of the relatively high-molecular-weight hydrocarbons normally present in a hydrocrackate lube oil stock and in order to avoid diffusion limitation problems, the carrier may desirably contain an appropriate amount, for example from about 3 to 30% of the pore volume, in pores (macropores) sized in the diameter range above 1000 Angstroms (determination being made by the mercury porosimetry method). A method for preparing a catalyst and/or carrier having the required pore volume and micropore and macropore distribution is disclosed in U.S. Pat. No. 4,102,822 (B.F. Mulaskey). Similarly, U.S. Pat. No. 4,081,406 (W. H. Sawyer) discloses a method for preparing porous alumina-based catalysts of predetermined pore size distribution and volume. In addition to alumina, the carrier may also contain a minor amount of one or more of the inorganic refractory metal oxides of Groups II and IV, for example silica, calcium oxide, magnesia, titania, and mixtures thereof, of the Periodic Chart of the Elements. Preferably, the carrier is amorphous and consists essentially of alumina, and more preferably contains at least 80 weight percent thereof.

The following example illustrates the process of this invention and is not intended to limit the scope.

EXAMPLE

Using the catalyst and feed described in the embodiment above, the effect of the hydrogenation temperature upon the UV stability of the resulting lube oil product was determined. The temperatures used were 204° C., 232° C., 260° C., 288° C., 315° C., 343° C., and 371° C. Other conditions and the results are shown in the FIGURE. These data demonstrate that a lube oil having an acceptable UV stability is obtained by hydrogenating a hydrocrackate feed using a catalyst having a pore volume and pore size distribution as specified herein, provided that the temperature used is in the range of from about 200° to 300° C.

STABILITY TEST

The UV stability of the lube oil is measured by placing the oil samples in glass bottles 16 mm in diameter, 50 mm high and having a wall thickness of about 1 mm. The caps are loosened and the bottles are placed in a circular rack surrounding a 450-watt cylindrical Hanovia Mercury vapor lamp (product of Conrad Precision Industries, Inc.) mounted in a vertical position. The distance along a line perpendicular to the longitudinal axis of the lamp extending from the longitudinal axis of the lamp to the longitudinal axis of the bottle is 2½ inches. The sample is observed over a period of time. At the first appearance of a light fine floc (small particles suspended in the oil), the time to formation of the floc is noted. The additional time until a moderate floc or heavy floc is also noted. In some cases of poor stability a ring of precipitated particles is observed clinging to the walls of the bottle.

What is claimed is:

1. A process for upgrading a hydrocrackate lube oil stock boiling in the range above 290° C. and having a UV stability below 3 hours, comprising: (1) contacting said stock and hydrogen gas with a catalyst containing Group VI-B and Group VIII hydrogenating components disposed upon a porous carrier consisting essentially of alumina having a pore volume in the range of from about 0.4 to 1.1 cc per gram, of which at least 70% is in pores having diameters in the range of from about 80 to 150 Angstroms, said contacting being under hydrogenating conditions, including (a) a temperature in the range of from about 200° to 300° C., (b) a total pressure in the range of from about 129 to 171 atmospheres, (c) a hydrogen rate in the range of from about 382 to 509 standard cubic meters of hydrogen gas per kiloliter of feed, and (d) a liquid hourly space velocity in the range of from about 1 to 3 V/V/hr, said Group VI-B component being selected from the group consisting of molybdenum and tungsten, and said Group VIII component being selected from the group consisting of cobalt and nickel, said components being in at least one of the metal, oxide and sulfide forms thereof, and being present in a total effective amount, calculated as metal and based upon the catalyst by weight, in the range of from about 1 to 20%; and (2) recovering, as a result of said contacting, a product lube oil having a UV stability of at least 4 hours.

2. A process as in claim 1 wherein said lube oil stock has a normal boiling point range of about 340° to 565° C., said hydrogenating temperature is a temperature in the range of from about 204° C. to 260° C., and at least 85% of said pore volume is in said range.

3. A process as in claim 1 wherein an amount in the range of from about 3 to 30% of said pore volume is in macropores.

4. A process as in claim 1 wherein said carrier contains at least 80 weight percent alumina.

5. In a process for upgrading a hydrocrackate lube oil stock boiling in the range above 340° C. and having a UV stability of less than 3 hours by hydrogenating said oil under hydrogenating conditions, including a suitable temperature, in the presence of gaseous hydrogen and a catalyst comprising a carrier having Group VI-B and VIII hydrogenation components disposed thereon, said components being in at least one of the metal, oxide and sulfide forms thereof, the improvement wherein (1) said temperature is in the range of from about 200° to 300° C., and (2) said carrier consists essentially of porous alumina having a pore colume in the range of from about 0.4 to 1.1 cc per gram, of which at least 70% is in pores having diameters in the range of from 80 to 150 Angstroms; and (3) recovering, as a result of said hydrogenating, a lube oil product having a UV stability of at least about 4 hours.

6. In a process for producing a lubricating oil from a feedstock selected from the group consisting of vacuum gas oils, deasphalted oils and mixtures, thereof, said feedstock having a normal boiling point range in the range above about 340° C., said process including steps of catalytically hydrocracking said feedstock in a hydrocracking zone under hydrocracking conditions and catalytically hydrogenating in a hydrogenating zone under hydrogenating conditions at least a substantial portion of the effluent from said hydrocracking zone, said portion having a UV stability of less than 3 hours and a normal boiling point range in the range of from about 290° C. to 650° C., said hydrogenating conditions including using a catalyst having a Group VI-B and a Group VIII hydrogenating agent disposed therein, said agents being in at least one of the metal, oxide and sulfide forms thereof, the improvement comprising carrying out said hydrogenating at a temperature in the range of from about 200° to 300° C., wherein said carrier consists essentially of porous alumina having a pore volume in the range of from about 0.4 to 1.1 cc per gram of which at least 70% is in pores having diameters in the range of from about 80 to 150 Angstroms, thereby producing a lube oil having a UV stability of at least about 4 hours.

7. A process as in claim 6 wherein said hydrocracking conditions include use of a hydrocracking catalyst which is a combination of nickel-tungsten-silica-alumina or nickel-molybdenum-silica-alumina.

8. A process as in claim 6 wherein said hydrocracking conditions include use of a hydrocracking catalyst which is a combination of nickel sulfide-tungsten sulfide on a silica-alumina base containing discrete, metal phosphate particles.

9. A process as in claim 6 wherein said hydrogenating catalyst contains cobalt or nickel and molybdenum or tungsten.

10. A process as in claim 6 wherein an amount of said pore volume in the range of from about 3 to 30 percent thereof is in macropores.

11. A process as in claim 6 wherein at least 85 percent of said pore volume of said hydrogenating catalyst is in said pore diameter range.

* * * * *

UNITED STATES PATENT AND TRADEMARK OFFICE

CERTIFICATE OF CORRECTION

PATENT NO. : 4,162,962

DATED : July 31, 1979

INVENTOR(S) : Bruce E. Stangeland

It is certified that error appears in the above-identified patent and that said Letters Patent are hereby corrected as shown below:

Col. 3, line 34, "0.5-" should read --0.5-2--.

Claim 5, Col. 6, line 10, "colume" should read --volume--.

Claim 5, Col. 6, line 12, "from 80" should read --from about 80--.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*